US008385156B2

(12) United States Patent
Ozawa

(10) Patent No.: US 8,385,156 B2
(45) Date of Patent: Feb. 26, 2013

(54) RADIO-CONTROLLED ADJUSTMENT TIMEPIECE

(75) Inventor: Kenji Ozawa, Narashino (JP)

(73) Assignee: Seiko Precision Inc., Chiba (JP)

( * ) Notice: Subject to any disclaimer, the term of this patent is extended or adjusted under 35 U.S.C. 154(b) by 548 days.

(21) Appl. No.: 11/922,654

(22) PCT Filed: Jun. 30, 2005

(86) PCT No.: PCT/JP2005/012128

§ 371 (c)(1),
(2), (4) Date: Jun. 3, 2009

(87) PCT Pub. No.: WO2007/004270

PCT Pub. Date: Jan. 11, 2007

(65) Prior Publication Data

US 2009/0296530 A1 Dec. 3, 2009

(51) Int. Cl.
*G04C 11/00* (2006.01)

(52) U.S. Cl. ..... 368/46; 368/21

(58) Field of Classification Search ..... 368/47, 368/21–22, 46

See application file for complete search history.

(56) References Cited

U.S. PATENT DOCUMENTS

| | | | | |
|---|---|---|---|---|
| 7,385,876 | B2 * | 6/2008 | Ihara et al. | 368/21 |
| 7,474,651 | B2 * | 1/2009 | Ozawa | 370/350 |
| 7,821,875 | B2 * | 10/2010 | Punkka | 368/21 |
| 2007/0206442 | A1 * | 9/2007 | Kim | 368/21 |

FOREIGN PATENT DOCUMENTS

| | | |
|---|---|---|
| EP | 1079285 A2 | 2/2001 |
| JP | 09-230070 | 9/1997 |
| JP | 2001-004764 | 1/2001 |
| JP | 2001-235568 | 8/2001 |
| JP | 2002-082186 | 3/2002 |
| JP | 2003-107178 | 4/2003 |
| JP | 2004-191263 | 7/2004 |
| JP | 2005-003373 | 1/2005 |

OTHER PUBLICATIONS

Austrian Patent Office Search report and Written Opinion mailed on Jul. 16, 2009 for Application No. 200718857-6 filed on Jun. 30, 2005 to Seiko Precision, Inc.

* cited by examiner

*Primary Examiner* — Sean Kayes
(74) *Attorney, Agent, or Firm* — Howard & Howard Attorneys PLLC

(57) ABSTRACT

A start date and an end date of a daylight saving time input by a user is stored in the daylight saving time information storage unit (41). The radio-controlled adjustment section (20) generates a time to adjust the time which the clocking unit (10) is clocking, by daylight saving time information and a standard time received via an antenna (AT) and a reception circuit (21), and adjusts the time of the clocking unit (10) by use of the generated time. Here, the daylight saving time determination unit (42) references to the daylight saving time period stored in the daylight saving time information storage unit (41), and adjusts the time of the clocking unit (10) so that the time becomes one which corresponds to the user-set daylight saving time.

10 Claims, 8 Drawing Sheets

RADIO-CONTROLLED ADJUSTMENT TIMEPIECE

TECHNICAL FIELD

The present invention relates to a radio-controlled adjustment timepiece.

BACKGROUND ART

A conventional radio-controlled adjustment timepiece is described in, for example, Patent Literature 1.

Patent Literature 1: Unexamined Japanese Patent Application KOKAI Publication No. 2003-107178

Presently, in Japan, under the governing by the National Institute of Information and Communications Technology, a standard wave representing time information is broadcast. In this standard wave containing the time information, a single complete frame lasts one minute. Each time frame contains time data representing: a year (last two digits of Christian Era), total dates (accumulated number of days counted from January 1), day-of-week, hour and minute; a parity bit and spare bits, etc.

More specifically, 1 bit is represented by a rectangular pulse having a frequency, 1 Hz, and "1" and "0" are represented by pulse durations of 500 ms and 800 ms, respectively. Each of time data, a parity bit and spare bits are represented by a binary code. The spare bits indicate whether it is within or without the daylight saving time, in the case where the daylight saving time is in effect. Additionally, the carrier wave for the standard wave utilizes long waves of frequencies 40 KHz and 60 KHz.

The radio-controlled adjustment timepiece of Patent Literature 1, upon the transition to daylight saving time and the associated change of time, adjusts the kept time so as to follow the transition.

Also in the U.S., a standard wave containing such time information is being broadcast; therefore, the current time kept by a radio-controlled adjustment timepiece can be adjusted. In this circumstance, because the time information contained in the standard wave in U.S. is Coordinated Universal Time (UTC), the current time should be adjusted based on an offset corresponding to a local time zone, from the UTC. On the day of the change to daylight saving time, it is determined whether the current local time of the area is after 0 o'clock in UTC and whether it is before or after the time upon which the transition to daylight saving time takes place. If the determination revealed that it is before the time, the arrival of the time to the transition to daylight saving time is waited for, and then the display time is set ahead by one hour. If it is after the time for the transition to daylight saving time, the display time is immediately set ahead by one hour.

DISCLOSURE OF THE INVENTION

Problem to be Solved by the Invention

However, the conventional radio-controlled adjustment timepiece described in Patent Literature 1 automatically adjusts the current time into a daylight saving time, based on the information contained in the standard wave. This inhibits uniquely changing the period of daylight saving time, or inhibits selection of adjusting for, or not adjusting for, the daylight saving time.

Moreover, an area, in which the standard wave cannot received, entails impossibility to determine whether the adjustment to follow the daylight saving time is carried out; therefore the problem was that, a correct current time cannot be displayed.

The present invention is made in view of the above-stated present states, and seeks to provide a radio-controlled adjustment timepiece that allows selection of adjusting for or not adjusting for the daylight saving time, as well as uniquely setting the period of daylight saving time.

Means for Solving the Problem

To achieve the above objective, the radio-controlled adjustment timepiece according to the first aspect of the present invention comprises receiving means which receives a standard wave containing time information and daylight saving time information indicating whether the time information includes a time adjustment value for a period of daylight saving time, clocking means which clocks a time, storage means which stores a period of daylight saving time set in advance independently from the daylight saving time information contained in regards to the period of daylight saving time in the standard wave;

daylight saving time control means which references to the contents stored in the storage means and the daylight saving time information, determines whether a current time is in the set daylight saving time period and specifies the current time, and adjusts the current time which the clocking means is clocking, by the specified time, wherein the daylight saving time control means:

when determining that the current time is in the set daylight saving time period, specifies the time information as the current time in the case where the time information contains the adjustment value, and specifies time information plus the adjustment value as the current time when the time information does not contain the adjustment value; and when determining that the current time is not in the set daylight saving time period, specifies the time information minus the adjustment value as the current time in the case where the time information contains the increments, and specifies the time information as the current time when the time information does not contain the adjustment value.

It may further comprise means which: disables the daylight saving time control means; when the time information contains the adjustment value, specifies a time derived by subtracting the adjustment value from the time information as the current time, and when the time information does not contain the adjustment value, specifies the time indicated by the time information as the current time; and adjusts the time which the clock means is clocking, by the specified current time.

It may further comprise means which: disables the daylight saving time control means: adjusts the time which the clocking means is clocking, by setting a time indicated by the time information as the current time.

To achieve the above objective, a radio-controlled adjustment timepiece according to a second aspect of the present invention comprise:

receiving means which receives a standard wave including time information and daylight saving time information indicating whether the time point thereof is in a daylight saving time period or not;

clocking means which clocks a time;

storage means which stores a period of daylight saving time set independently from the daylight saving time information contained in regards to the period of daylight saving time in the standard wave;

daylight saving time control means which: references to the contents stored in the storage means; determines whether the current time is in the set daylight saving time period; when determining that the current time is in the set daylight saving time period, specifies the time information plus the adjustment value of the daylight saving time period as the current time, and specifies the time information as the current time when determining that the current time is not in the daylight saving time period; and adjusts the time which the clocking means is clocking by the specified current time.

It may further comprise means which: disables the daylight saving time control means; when the daylight saving time information indicates that it is in the daylight saving time period, specifies a time derived by adding the adjustment value to the time information as the current time; when it is not in the daylight saving time period, specifies the time which the time information indicates as the current time; and adjusts the time which the clocking means is clocking, by the specified current time.

It may further comprise means which: disables the daylight saving time control means; specifies the time indicated by the time information as the current time; adjusts the time which the clocking means is clocking by the specified current time.

The above-stated radio-controlled adjustment timepiece according to the first or the second aspect of the present invention may comprise time difference adjustment means which adjust the time which the clocking means is clocking, by adding a value that corresponds to a time difference set separately for each of areas.

In this case, the receiving means may receive the standard wave on or after that the time adjusted by the time difference adjustment means becomes the set daylight saving time period, and the daylight saving time control means may adjust the time which the clocking means is clocking, based on a result of reception of the standard wave, by the receiving means.

Effect of the Invention

According to the present invention, it is possible to select adjusting for or not adjusting for a daylight saving time, as well as uniquely setting the period of the daylight saving time.

EXPLANATION OF REFERENCE NUMERALS

Figure 1:
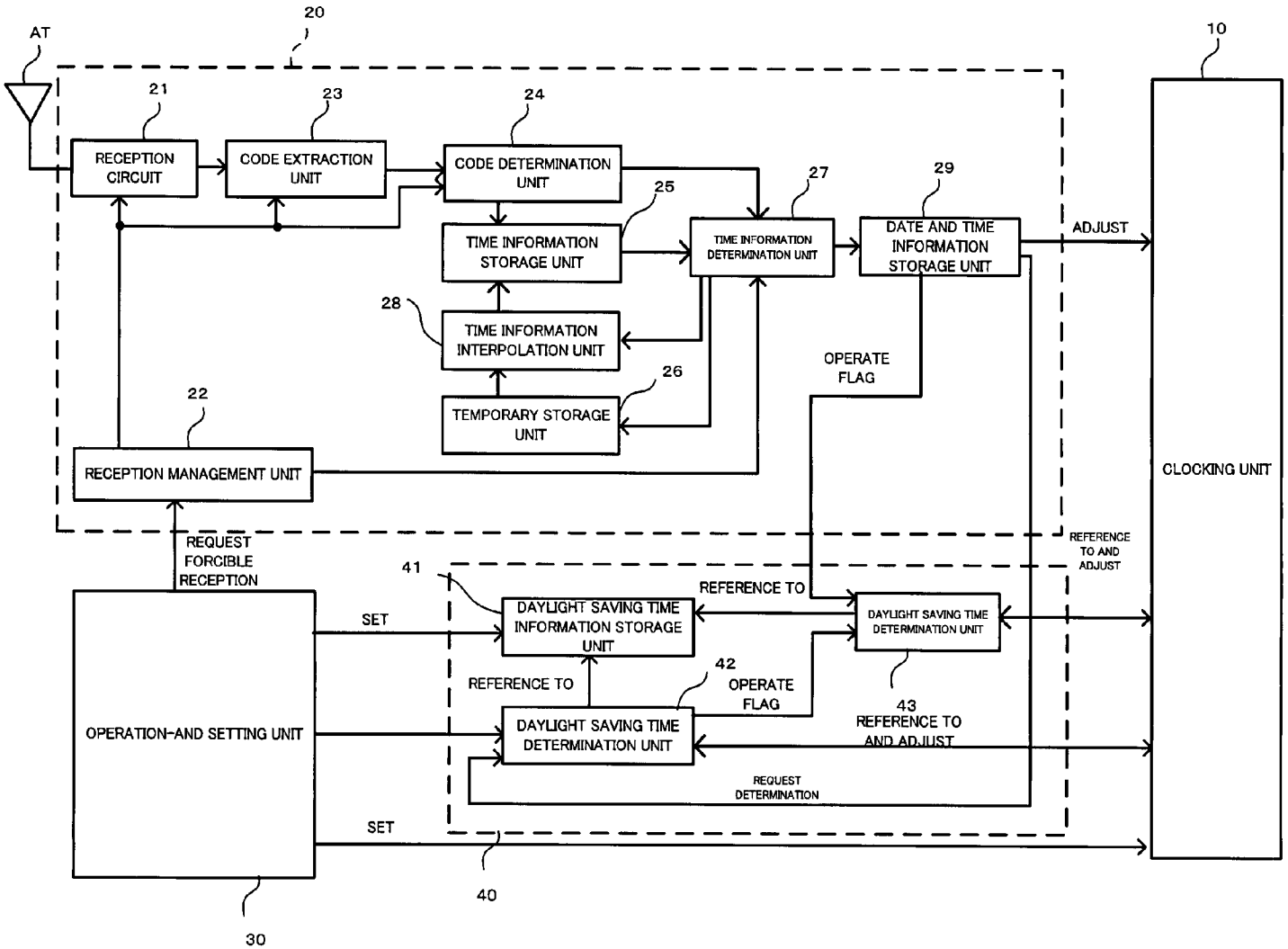
FIG. 1 is a diagram showing the radio-controlled adjustment timepiece according to a first embodiment of the present invention.

10, 50 clocking unit
20, 60 radio-controlled adjustment section
21, 61 reception circuit
22, 62 reception management unit
23, 63 code extraction unit
24, 64 code determination unit
27, 37 time information determination unit
29, 69 date-and-time information generation unit
30. 80 operation-and-setting unit
40, 90 auto daylight saving time control section

BEST MODE FOR CARRYING OUT THE INVENTION

Hereafter the embodiments of the present invention are described in detail with reference to the drawings.

First Embodiment

FIG. 1 is a block diagram showing an exemplary configuration of a radio-controlled adjustment timepiece according to a first embodiment of the present invention.

This radio-controlled adjustment timepiece receives a standard wave, which is broadcast across Japan, and adjusts a time which it is clocking, so as to accord to time information contained in the standard wave. The radio-controlled adjustment timepiece comprises a clocking unit 10 for clocking the current time and outputting the time, a radio-controlled adjustment section 20 for receiving a standard wave and sequentially adjusting the time which the clocking unit 10 is clocking, based on the time information contained in the standard wave; an operation-and-setting unit 30 and an auto daylight saving time control section 40.

The operation-and-setting unit 30 comprises not-shown user-operable switches or buttons, etc. The buttons are for use in inputting, e.g. date-and-time information. Through the input of date-and-time information the current time clocked by the clocking unit 10 is changeable, and a start date and an end date of the daylight saving time can be set uniquely. The switches are also for use in giving instructions to the radio-controlled adjustment section 20 to e.g. forcibly acquiring time information from the standard wave, and adjusting the current time clocked by the clocking unit 10 based on the time information.

The radio-controlled adjustment section 20 comprises a reception circuit 21 connected to an antenna AT that receives the standard wave and a reception management unit 22. To the reception circuit 21 is connected a code extraction unit 23, to which is connected a code determination unit 24. To the code determination unit 24 is connected a time information storage unit 25 comprising a memory.

The reception circuit 21 detects a standard wave provided via the antenna AT. The reception circuit 21 outputs a time signal, which is an electric signal. The reception management unit 22, at a pre-set timing and at the reception of instruction of forcible reception from the operation-and-setting unit 30, activates the reception circuit 21, the code extraction unit 23, the code determination unit 24, and the time information determination unit 27. The pre-set timing is for example, once or a plurality of times a day, for example 2:00 AM or 5:00 AM, or every predetermined hour, e.g. three hours, from AM 0:00.

The code extraction unit 23 is means which extracts, from the time signal output by the reception circuit 21, time information indicating date and time. The code determination unit 24 is operable to determine whether the value of each item of the time information is normal or not. The time information storage unit 25 comprises a memory, or the like. The time information storage unit 25 stores the time information, the value of each item which is determined as normal by the code determination unit 24.

This radio-controlled adjustment section 20 is further provided with a temporary storage unit 26, a time information determination unit 27, a time information interpolation unit 28, and a date-and-time information generation unit 29.

The time information determination unit 27 determines the conformity of the values of the items of the time information stored in the time information storage unit 25. The time information determination unit 27 lets the value of the item, which is determined to have conformity, stored in the temporary storage unit 26.

Further, the time information determination unit 27 determines whether all the items of the time information stored in the time information storage unit 25 have obtained a value with conformity. If it is determined that those values are not obtained, it activates the time information interpolation unit 28. The time information interpolation unit 28 reads out from the temporary storage unit 26 the values for the items, which have not yet obtained the values with conformity, in the time information storage unit 25, and stores those values in the time information storage unit 25. That is, the time information interpolation unit 28 performs interpolation. The time information determination unit 27, when determining that the values of all the items, which are stored in the time information storage unit 25, of the time information have conformity, supplies all the values of the items of the time information to the date-and-time information generation unit 29. The date-and-time information generation unit 29 generates date and time information for adjusting the current time being clocked by the clocking unit 10, based on the values of the time information supplied by the time information determination unit 27, then providing it to the clocking unit 10.

Auto daylight saving time control unit 40 comprises a daylight saving time information storage unit 41, a daylight saving time determination unit 42, and a daylight saving time execution unit 43.

The daylight saving time information storage unit 41 stores a daylight saving time start date and a daylight saving time end date, which are input through the operation-and-setting unit 30. These daylight saving time start date and end date are information regarding dates, which indicate the period of daylight saving time uniquely set in advance by a user through operating the buttons of the operation-and-setting unit 30. In order that the users are allowed to set the start date and end date of the daylight saving time, this embodiment may store the daylight saving time start time and the end time in the daylight saving time information storage unit 41, as well as the start and end dates thereof, in accord with the configuration in which the start date and the end date of the daylight saving time are stored in the daylight saving time information storage unit.

The daylight saving time determination unit 42 is operable to refer to the daylight saving time information storage unit 41, and operable to control the daylight saving time flag. The daylight saving time determination unit 42 is operable to adjust the time clocked by the clocking unit 10. That is, the daylight saving time determination unit 42, referring to the time clocked by the clocking unit 10, turns the daylight saving time flag into "1" (ON), which indicates 'effective', if the referred time corresponds to the user-set daylight saving time period. If the referred time does not correspond to the user-set daylight saving time period, the daylight saving time determination unit 42 turns the daylight saving time flag into "0" (OFF), which indicates 'ineffective'.

The daylight saving time execution unit 43 is operable to adjust the time clocked by the clocking unit 10, if the daylight saving time flag is ON.

Next, the operation of the radio-controlled adjustment timepiece will be described.

Figure 2:
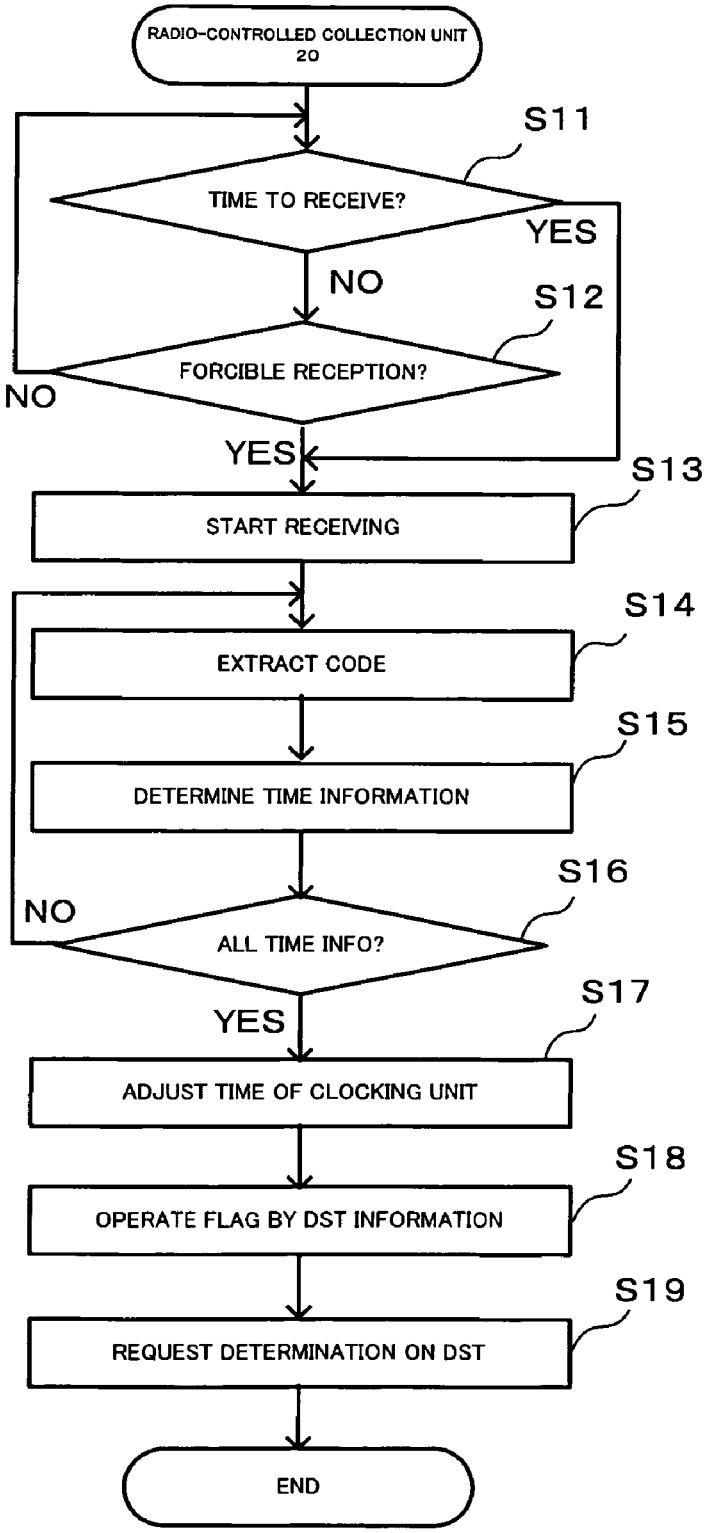
FIG. 2 is a flowchart showing a process performed by the radio-controlled adjustment section.

FIG. 2 is a flowchart showing the process performed by the radio-controlled adjustment section 20.

Figure 3:
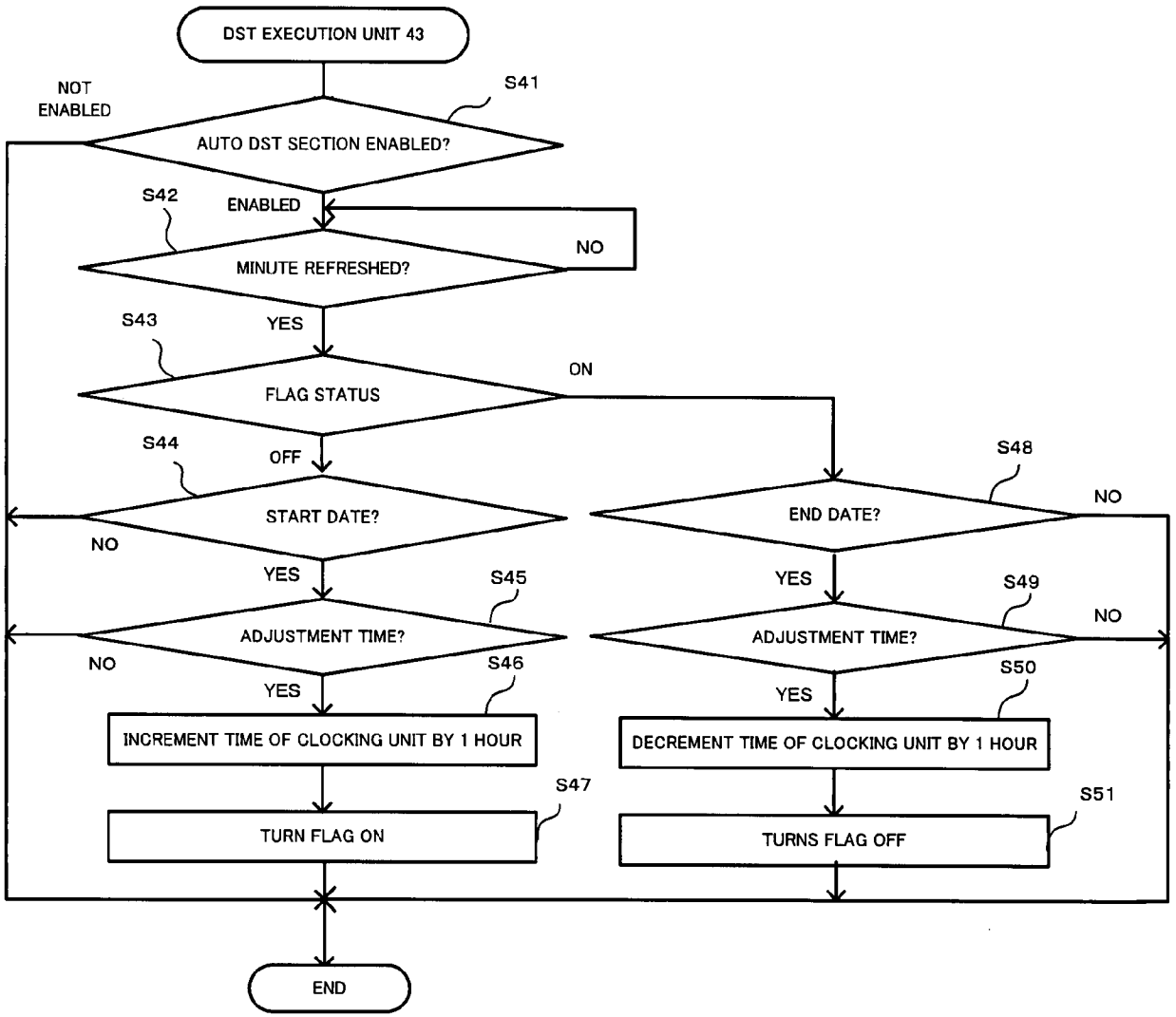
FIG. 3 is a flowchart showing a process performed by the daylight saving time execution unit.

FIG. 3 is a flowchart showing the process performed by the daylight saving time execution unit 43.

Figure 4:
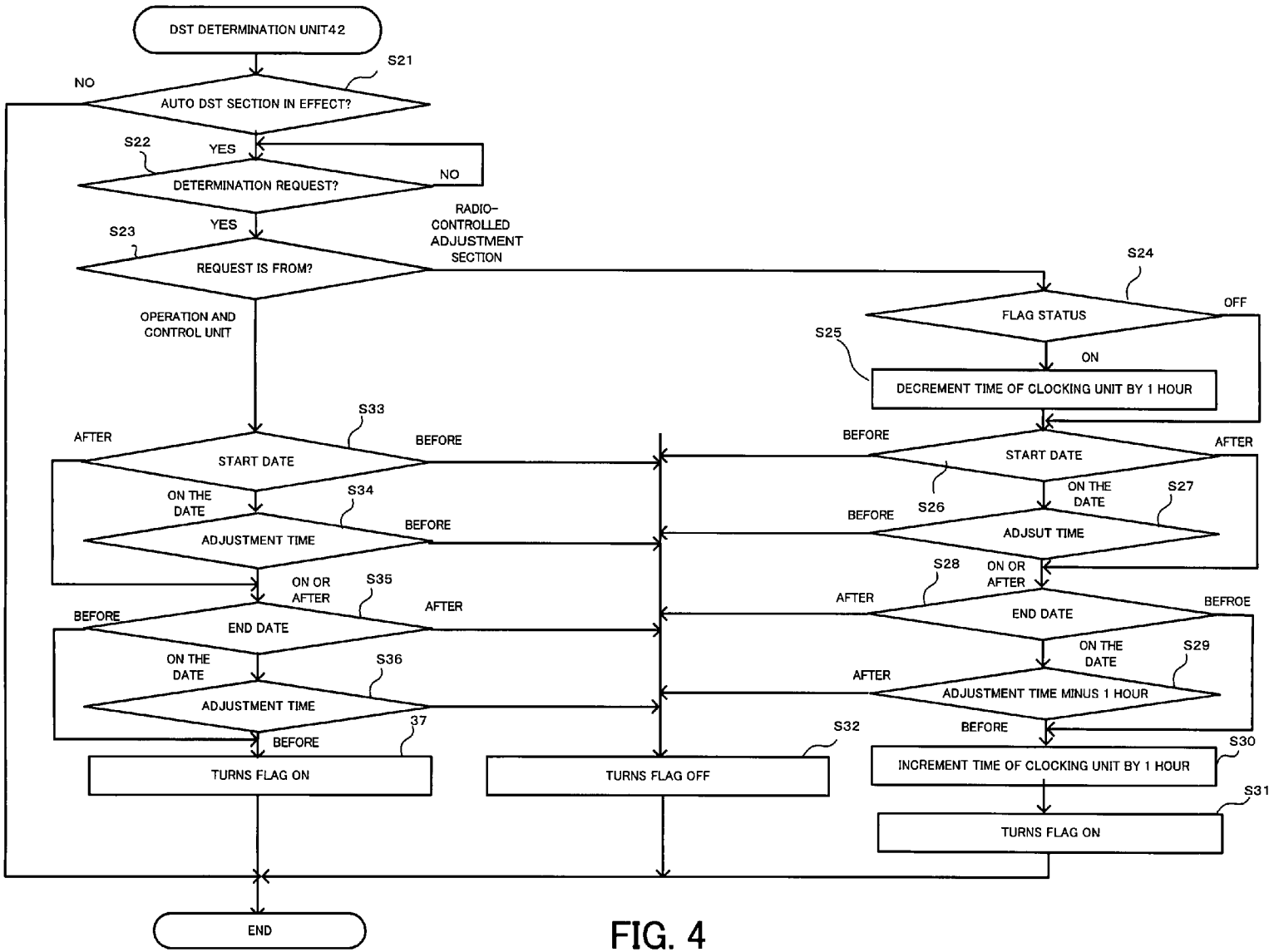
FIG. 4 is a flowchart showing the process performed by the daylight saving time determination unit.

FIG. 4 is a flowchart showing the process performed by the daylight saving time determination unit 42.

By operating the buttons, etc. of the operation-and-setting unit 30, the user can uniquely input the period of the daylight saving time. Specifically, the buttons, etc., are utilized to input the start date and end date of the daylight saving time. The start date and end date of the daylight saving time are stored in the daylight saving time information storage unit 41. Hereafter the operation is continuously described on a premise that the daylight saving time start date and end date which indicate the user-set daylight saving time period is stored in the daylight saving time information storage unit 41 in advance.

The reception management unit 22 of the radio-controlled adjustment section 20, awaits for the arrival of the pre-set timing (step S11). If the timing does not come (step S11: NO), the reception management unit 22 awaits for the instruction of forcible reception (step S12). The instruction of the forcible reception is given by the operation-and-setting unit 30, when the user turns the switches of the operation-and-setting unit 30 on.

When the pre-set timing comes (step S11; YES), or an instruction of the forcible reception is given (step S12: YES), the reception management unit 22 activates a reception circuit 21, a code extraction unit 23, a code determination unit 24, and a time information determination unit 27.

The activated reception circuit 21 receives a standard wave via the antenna AT (step S13).

The reception circuit 21 detects a time signal having a frequency 1 Hz, after amplifying the low frequency standard wave.

In the time information contained in this standard wave, a single complete frame lasts one minute, and contains time data representing: a year (last two digits of Christian Era), total dates (accumulated number of days counted from January 1), day-of-week, hour and minute; a parity bit and spare bits. More specifically, 1 bit is represented by a rectangular pulse having a frequency, 1 Hz, and "1" and "0" of the time information are represented by pulse durations of 500 ms and 800 ms, respectively. Each of time information, a parity bit and spare bits are represented by a binary code. The spare bits, where the daylight saving time is in effect, indicate whether it is within or without the daylight saving time. Additionally, the carrier wave for the standard wave utilizes long waves of frequencies 40 KHz and 60 KHz.

The code extraction unit 23 detects a pulse duration of a time signal of 1 Hz, which is detected by the reception circuit 21. The code extraction unit 23 extracts: a binary code; a code corresponding to time information, exemplified by a position marker; and the daylight saving time information, etc.

The code determination unit 24, after detecting the beginning of one frame, from the code extracted by the code extraction unit 23, starts conversion of the binary code into time information, such as hour and minutes, based on a format of time code information specified in a low frequency standard wave, and starts code determination for determining the normality or abnormality of each piece of daylight saving time information and time information (step S14).

Here the code determination is explained specifically. According to the format of the time code information, the first to the eighth pulses from the beginning of the frame provides time information indicating a minute. The binary code of the time information of a minute is extracted to thereby generate a BCD code of the minute.

The same applies to the conversion into BCD code indicating other time information, such as hour, total dates, year, day-of-week and daylight saving time information. If the converted BCD code includes dropout of bits or the BCD code is of a bit pattern that is invalid as a BCD code, the code is determined as abnormal and discarded. The information thence determined to be normal, of the time information and daylight saving time information, is output to the time information storage unit 25.

The time information and the daylight saving time information, which is provisionally determined to be normal by the code determination unit 24, is written to a predetermined storage area provided for the time information storage unit 25. Each storage area of the time information storage unit 25 is cleared to a prescribed value, in advance. The prescribed value references to a value that will not recognized as any piece of the time information and the daylight saving time information.

When the reception of one frame is completed, the time information determination unit 27 executes determination on the time information and the daylight saving time information (step S15).

In the determination on the time information and the daylight saving time information, time information and daylight saving time information collected by the time information storage unit 25 are referred to, and the validity of the values as information, of each item of the time information and the daylight saving time information is determined.

Each determination includes, for example for minute, error detection in the bits executed by use of the parity bit, and whether being within or without the range of 00 to 59; for hours error detection in the bits executed by the parity bit and whether being within or without the range of 0 to 23; for year whether being within or without the range of 00 to 99; for day-of-week whether being within or without the range of 0 to 6; for total dates whether being in the range of 1 to 366 or 365, etc.

The time information determination unit 27 determines whether the determination on the time information and the daylight saving time information shows that all the items of the time information and daylight saving time information are together normal, and when determining that the items are normal all together (step S16: YES), supplies the time information and the daylight saving time information to the date-and-time information generation unit 29, after advancing it by one minute.

On the other hand, when all the time information is not together normal, (step S16: NO), only the time information determined to be normal is temporarily stored to the temporary storage unit 26.

When the time information or daylight saving time information is temporarily stored to the temporary storage unit 26, the time information interpolation unit 28 advances time information of the temporary storage unit 26. Specifically, when the next frame is received, since one frame of time information is configured to be one minutes, the minute is incremented by 1. If the incremented value of minute becomes 60, the digit of minute is carried, thus the minutes becoming 00 and hour being incremented by 1. Similarly, determination on carrying digits is made in the order of on hour, total dates, day-of-week and year, then necessary processes being performed. After the incrementing, further, parity bits for hour and minute are generated from the incremented time information. Here, the generated parity bit allows a provisional bit error detection by BCD codes of hour and minute and the generated parity bit even if only the reception of the parity bit is failed during the reception of the next frame.

Upon completion of the generation of the parity bit, interpolation is performed on the time information or daylight saving time information read out from the temporary storage unit 26, and they are stored in the time information storage unit 25 with the generated parity bit.

When the interpolation on the time information or daylight saving time information is executed, the process goes back to step S14, and code extraction, code determination, collection of the time information, and the determination of the time information are executed. By the execution of the code extraction, code determination, collection of the time information, and the determination of the time information, receiving process for receiving the time information of the new frame is continued.

When all the items of the time information and the daylight saving time information become together normal (step S16: YES), and, as a result of that, the time information and the daylight saving time information are input from the time information determination unit 27 to the date-and-time information generation unit 29, and the date-and-time information generation unit 29 generates a time to adjust the time being clocked by the clocking unit 10, based on the time information and the daylight saving time information. By the generated time, the date-and-time information generation unit 29 adjusts the time of the clocking unit 10 (step S17).

Additionally, the date-and-time information generation unit 29 turns the daylight saving time flag on when the daylight saving time information indicates that it is in the daylight saving time. When the daylight saving time information shows that it is not the daylight saving time, the date-and-time information generation unit 29 turns the daylight saving time flag off (step S18).

After the setting of on and off of the daylight saving time flag, the date-and-time information generation unit 29, outputs a determination request to the daylight saving time determination unit 42.

As shown in FIG. 4, the daylight saving time determination unit 42 is waiting for a determination request (step S22: NO), when a start date and an end date of the daylight saving time are stored in the daylight saving time information storage unit 41 in advance and the auto daylight saving time control section 40 is enabled (step S21: YES). When the daylight saving time determination unit 42 determines that there is a determination request (step S22: YES), it determines whether the determination request is from the radio-controlled adjustment section 20, or from the operation-and-setting unit 30. The request from the radio-controlled adjustment section 20 is generated by the date-and-time information generation unit 29. The determination request transmitted from the operation-and-setting unit 10 is generated by the operation-and-setting unit 30, in the case where the time is input to the operation-and-setting unit 30 from the operation-and-setting unit 30, by the user for the intention of changing the time clocked by the clocking unit 10.

When the determination request is from the radio-controlled adjustment section 20 (step S23: radio-controlled adjustment section), the daylight saving time determination unit 42 determines whether the daylight saving time flag (summer time flag) is ON or OFF. When the daylight saving time flag is ON (step S24: ON), the daylight saving time determination unit 42 decrements the time being clocked by the clocking unit 10 by one hour (step S25).

When the daylight saving time determination unit 42 determines that the daylight saving time flag is OFF (step S24: OFF) or after that the time of the clocking unit 10 is decremented by one hour, it references to the daylight saving time information storage unit 41, and determines if the one-hour decremented time, which the clocking unit 10 is clocking, is before, after or on the start date of the user-set daylight saving time. If it is on the start date of the user-set daylight saving time (step S26: the start date), the daylight saving time determination unit 42 determines whether it is before, or on or after the time to enter the daylight saving time (adjustment time).

When determining it is on or after the time to enter the daylight saving time (step S27: on or after) or, when determining it is after the start date of the daylight saving time (step S26: after), the daylight saving time determination unit 42 determines whether the one-hour decremented time, which the clocking unit 10 is clocking, is before, after, or on the end date of the daylight saving time.

When determining that it is the end date of the daylight saving time (step S28: the end date), the daylight saving time determination unit 42 determines whether the time, which the clocking unit 10 is clocking, is before, or on or after the one-hour decremented time with respect to the end time of the daylight saving time (adjustment time). When determining that the time of the clocking unit 10 is before the one-hour decremented time with respect to the end time of the daylight saving time (step S29: before) or determining that it is before the end date of the daylight saving time (step S28: before), the daylight saving time determination unit 42 increments the time, which the clocking unit 10 is clocking, by one hour, since this case corresponds to the user-set daylight saving time period (step S30). Then, the daylight saving time determination unit 42 turns the daylight saving time flag on (step S31).

When it is determined in step S26 that the time clocked by the clocking unit 10 is before the start date of the daylight saving time (step S26: before); when it is determined in step S27 that the time the clocking unit 10 is clocking is before the time to enter the daylight saving time (step S27: before); when it is determined in step S28 that the time the clocking unit 10 is clocking is after the end date of the daylight saving time (step S28: after); or when it is determined in step S29 that the time of the clocking unit 10 is on or after the one-hour decremented time with respect to the end time of the daylight saving time (step S29: on or after), the daylight saving time determination unit 42, turns the daylight saving time flag off (step S32).

On the other hand, when it is determined in step S23 that the determination request is from the operation-and-setting unit 10 (step S23: operation-and-control unit), the daylight saving time determination unit 42 references to the daylight saving time information storage unit 41, and determines whether the time which the clocking unit 10 is clocking is before, after or on the start date of the user-set daylight saving time. When it is the user-set date of the daylight saving time (step S33: the date), the daylight saving time determination unit 42, determines whether it is before or on or after the time to enter the daylight saving time (adjustment time).

When determining that it is on or after the time to enter the daylight saving time (step S34: on or after) or, determining that it is after the start date of the daylight saving time (step S33: after), the daylight saving time determination unit 42 determines whether the time of the clocking unit 10 is before, after or on the end date of the user-set daylight saving time.

When determining that it is the end date of the daylight saving time (step S35: the end date), the daylight saving time determination unit 42 determines whether the time the clocking unit 10 is clocking is on or after the time at which the daylight saving time ends (adjustment time). In the case where the time of the clocking unit 10 is before the time at which the daylight saving time ends (step S36: before) or before the end date of the daylight saving time (step S35: before), the daylight saving time determination unit 42 turns the daylight saving time flag on (step S37) since the case corresponds to the user-set daylight saving time period.

When determining in step S33 that the time which the clocking unit 10 is clocking is before the start date of the daylight saving time (step S33: before); when determining in step S34 that the time which the clocking unit 10 is clocking is before the time to enter the daylight saving time (step S34: before); when determining in step S35 that the time clocking unit 10 is clocking is after the end date of the daylight saving time (step S35: after); or, when determining in step S36 that the time the clocking unit 10 is clocking is on or after the time at which the daylight saving time ends (step S36: on or after), the daylight saving time determination unit 42 turns the daylight saving time flag off (step S32).

The processes performed by the daylight saving time determination unit 42 allows adjusting the time of the clocking unit 10 in accordance with the user-set daylight saving time period in the case where the time of the clocking unit 10 is adjusted based on the standard wave, or in the case where the user adjusts the time of the clocking unit 10 by the use of the operation-and-setting unit 30.

On the other hand, as shown in FIG. 3, the daylight saving time execution unit 43 monitors the time the clocking unit 10 is clocking, and waits for refresh of the minutes (step S42: NO) in the case where the daylight saving time information storage unit 41 stores in advance the start date and the end date of the daylight saving time, and where the auto daylight saving time control section 40 is enabled (step S41: YES), it waits for the refresh of the minute.

When determining that the clocking unit 10 has refreshed the minute (step S42: YES), the daylight saving time execution unit 43 determines whether the daylight saving time flag is on or off. When the daylight saving time flag is off (step S43: off), the daylight saving time execution unit 43 determines whether the time of the clocking unit 10 is the start date of the user-set daylight saving time.

When the time of the clocking unit 10 is on the start date of the daylight saving time (step S44: YES), the daylight saving time execution unit 43 determines whether the time of the clocking unit 10 is the time to enter the daylight saving time (adjustment time). When the time of the clocking unit 10 is the time to enter the daylight saving time (step S45: YES), it increments the time of the clocking unit 10 by one hour (step S46). Then, the daylight saving time execution unit 43 turns the daylight saving time flag on (step S47). That is, when the time the clocking unit 10 is clocking comes into the user-set daylight saving time period, the time of the clocking unit 10 is incremented by one hour.

When it is determined in step 43 that the daylight saving time flag is ON (step 43: ON), the daylight saving time execution unit 43 determines whether the time of the clocking unit 10 is the end date of the user-set daylight saving time. When the time of the clocking unit 10 is on the end date of the daylight saving time (step S48: YES), the daylight saving time execution unit 43 determines whether the time of the clocking unit 10 is to be out from the daylight saving time (adjustment time). In the case where the time of the clocking unit 10 is one which is to be out from the daylight saving time (step S49: YES), the daylight saving time execution unit 43 decrements the time of the clocking unit 10 by one hour (step S50). Then, the daylight saving time execution unit 43 turns the daylight saving time flag off (step S51).

When by the processes performed by the daylight saving time execution unit 43 the time clocked by the time, which the clocking unit 10 is clocking, enters into the user-set daylight saving time period, the time of the clocking unit 10 is incremented by one hour, while when being out from the daylight saving time period, the time of the clocking unit 10 recurs to the original state.

The radio-controlled adjustment timepiece of this embodiment affords clocking by the clocking unit 10 in accordance with the user-set daylight saving time period whether the time information contained in the standard wave is under the daylight saving time, or under the winter time.

When the user-input start date and end date of the daylight saving time is the same date, substantially the period of the daylight saving time becomes null; therefore, the clocking unit 10 clocks a time that does not adopt the daylight saving time.

Further, when the start date and end date of the daylight saving time are not input by the user, the auto daylight saving time control section 40 becomes disabled, and the clocking unit 10 clocks a time in accordance with the time information given by the standard wave.

Second Embodiment

Figure 5:
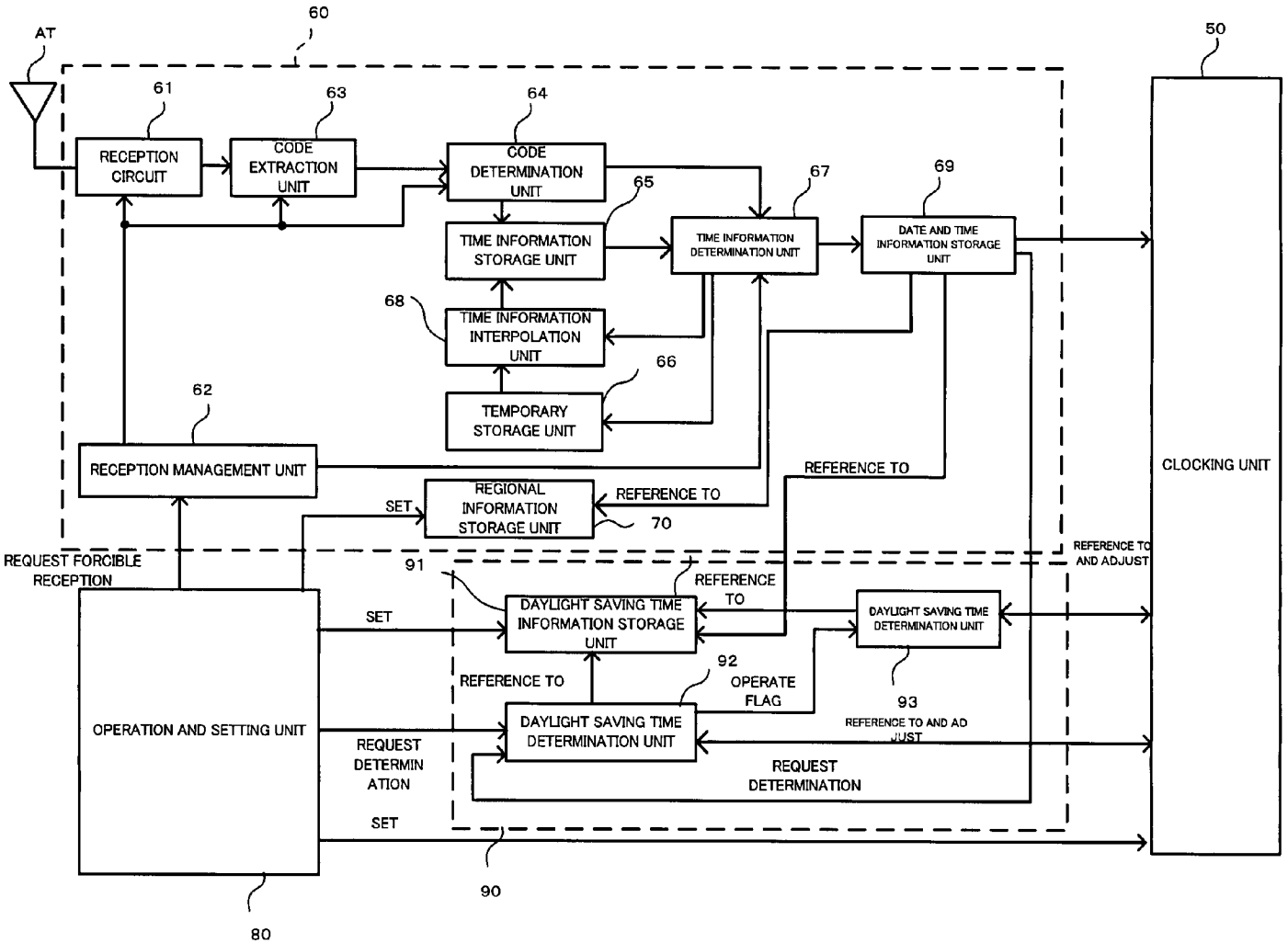
FIG. 5 is a diagram showing a radio-controlled adjustment timepiece according to a second embodiment of the present invention.

FIG. 5 is a block diagram showing a radio-controlled adjustment timepiece according to a second embodiment of the present invention.

In this embodiment, a radio-controlled adjustment timepiece used in a country, for example, United States, divided into different time zones for different areas, will be described. The description is provided hereafter on a premise that the radio-controlled adjustment timepiece is capable of receiving a standard wave (WWVB) broadcast across the United States, and adjusting the time it is clocking, based on the time information contained in the standard wave. In the case of the United States, the time information contained in the standard wave is UTC (Coordinated Universal Time), and it is required that the reception side uses it in consideration of the different time zone of the target area. Further, the time information is not one adjusted by the daylight saving time, even in the period where the daylight saving time is in effect. The daylight saving time information that indicates that it is within the period in which the daylight saving time is in effect, is contained in the standard wave.

The radio-controlled adjustment timepiece shown in FIG. 5 comprises a clocking unit 50 which clocks and outputs a current time, a radio-controlled adjustment section 60 which receives a standard wave and sequentially adjusts the time which the clocking unit 50 is clocking, based on the time information contained in the standard wave, an operation-and-setting unit 80, and an auto daylight saving time control section 90.

The radio-controlled adjustment section 60 comprises a reception circuit 61 connected to an antenna AT which receives a standard wave, a reception management unit 62, a code extraction unit 63 connected to a reception circuit 61, and a code determination unit 64 connected to a code extraction unit 63. To the code determination unit 64 is connected a time information storage unit 65 comprising a memory.

The reception circuit 61, the reception management unit 62, the code extraction unit 63, the code determination unit 64 and the time information storage unit 65 are of the similar configuration as the reception circuit 21, the reception management unit 22, the code extraction unit 23, the code determination unit 24 and the time information storage unit 25 of the first embodiment.

To the radio-controlled adjustment section 60, further, a temporary storage unit 66, a time information determination unit 67, a time information interpolation unit 68, a date-and-time information generation unit 69, and regional information storage unit 70.

The temporary storage unit 66, the time information determination unit 67 and the time information interpolation unit 68 are equivalent to the temporary storage unit 26, time information determination unit 27 and the time information interpolation unit 28 of the first embodiment.

The regional information storage unit 70 stores, as area information input from the operation-and-setting unit 80, a time difference of the target area with respect to UTC. For example, the U.S. has four time zones, Eastern Time, Central Time, Mountain Time, and Pacific Time, which are different from UTC by −5 hours, −6 hours, −7 hours, and −8 hours, respectively. From this time zones, a target area is selected by the input through the operation-and-setting unit 80, and the target time difference is stored in the regional information storage unit 70. The date-and-time information generation unit 69 generates date and time information for adjusting the current time the clocking unit 50 is clocking, from the values of time information provided from the time information determination unit 67. The date-and-time information generation unit 69 increments the date and time information, by the time difference stored in the regional information storage unit 70, and provide it to the clocking unit 50.

An auto daylight saving time control unit 90 comprises a daylight saving time information storage unit 91, a daylight saving time determination unit 92, and a daylight saving time execution unit 93.

The daylight saving time information storage unit 91 is equivalent to the daylight saving time information storage unit 41 of the first embodiment. The daylight saving time information storage unit 91 stores daylight saving time start date and the daylight saving time end date input through the operation-and-setting unit 80.

The daylight saving time determination unit 92 is operable to refer to the daylight saving time information storage unit 91 and control a daylight saving time flag. The daylight saving time determination unit 92 is operable to adjust the time which the clocking unit 50 is clocking.

The daylight saving time execution unit 93 is operable to adjust the time which the clocking unit 50 is clocking, when the daylight saving time flag is on.

Figure 6:
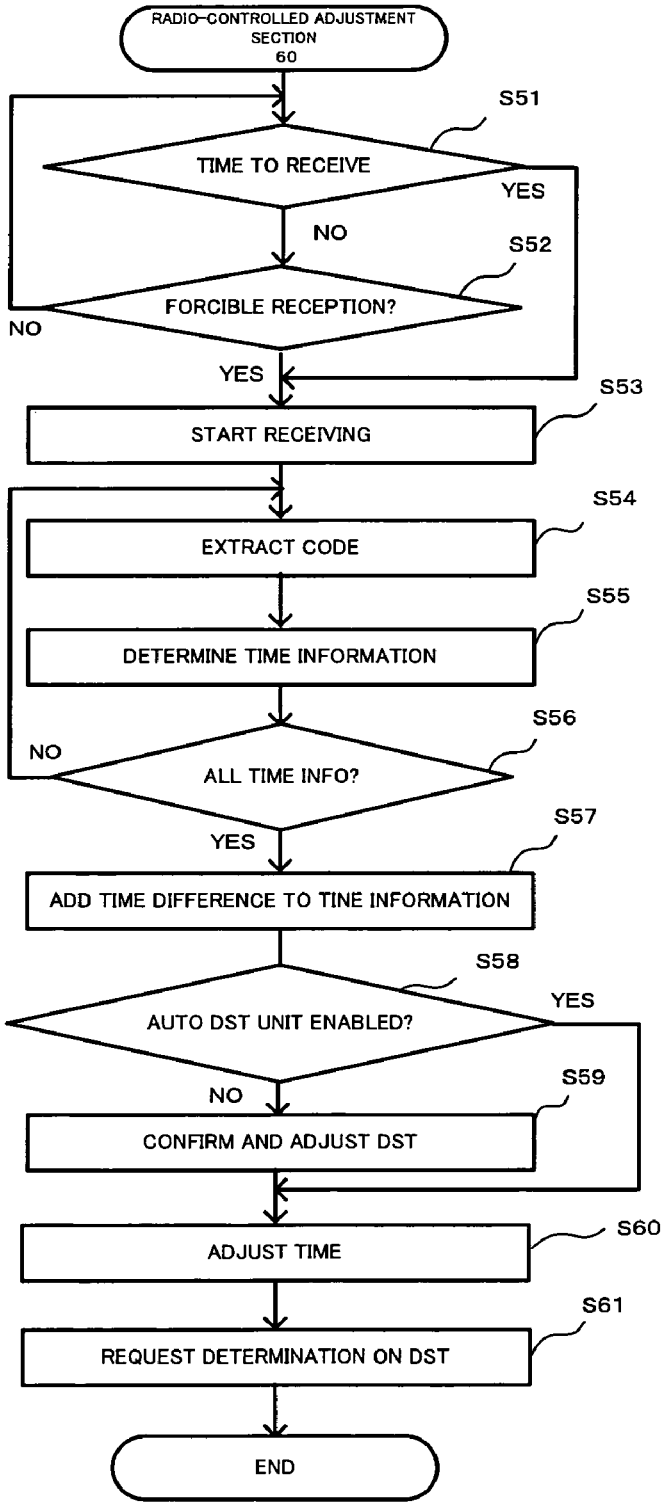
FIG. 6 is a flowchart showing a process performed by the radio-controlled adjustment section.

FIG. 6 is a flowchart showing the process performed by the radio-controlled adjustment section 60.

Figure 7:
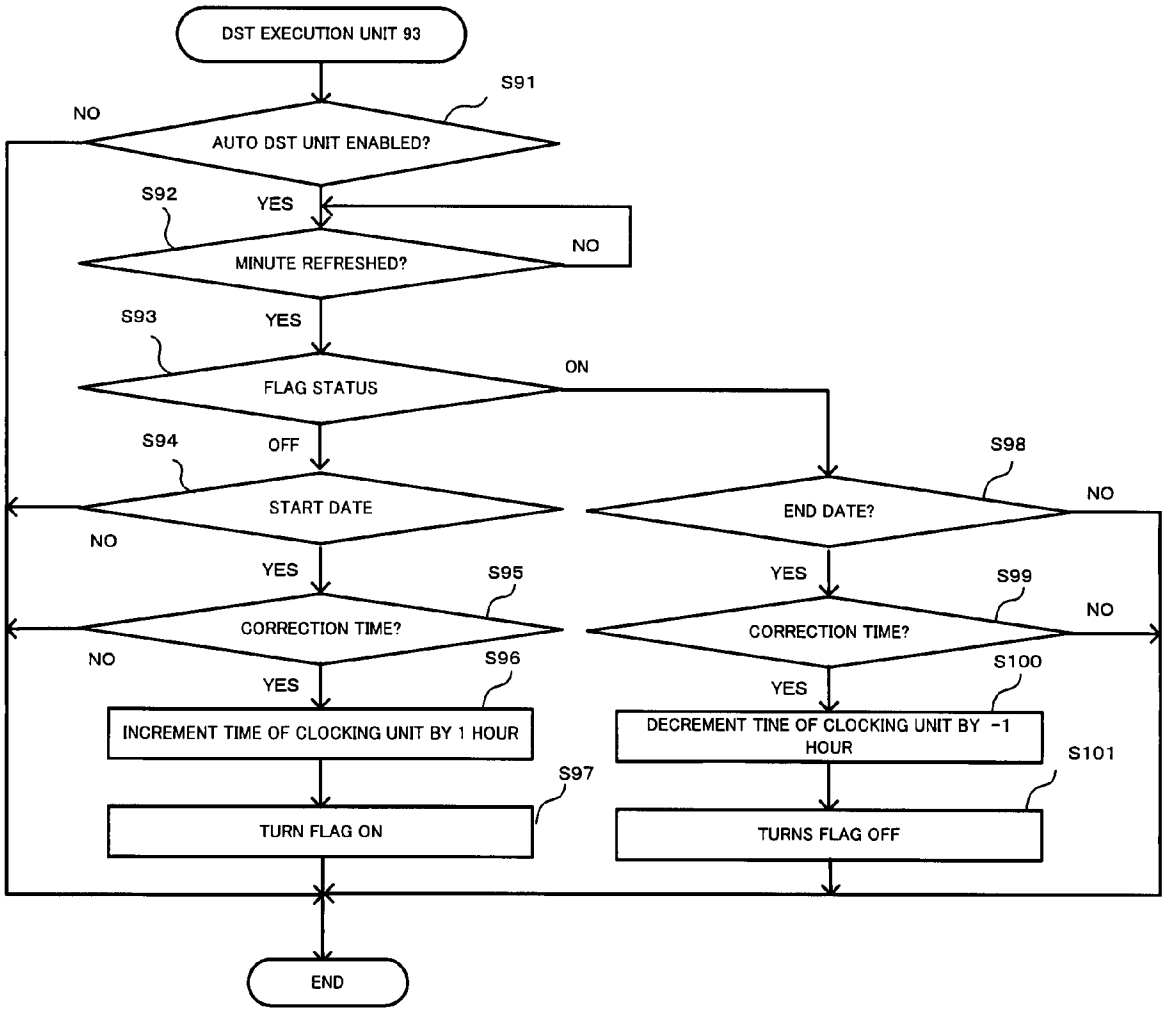
FIG. 7 is a flowchart showing the process performed by the daylight saving time execution unit.

FIG. 7 is a flowchart showing the process performed by the daylight saving time execution unit 93.

Figure 8:
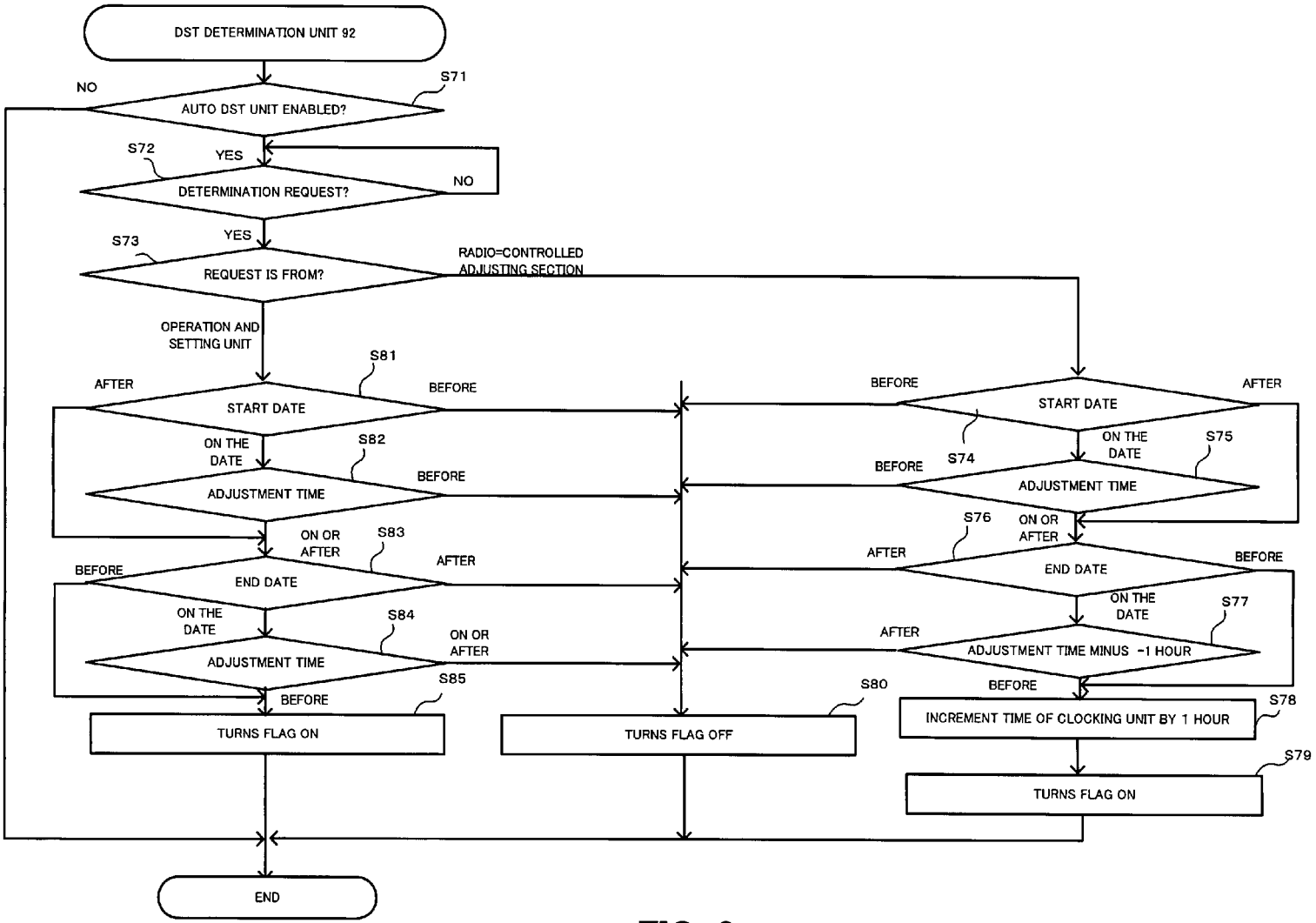
FIG. 8 is a flowchart showing the process performed by the daylight saving time determination unit.

FIG. 8 is a flowchart showing the process performed by the daylight saving time determination unit 92.

The user can uniquely input the period of the daylight saving time by operating buttons, etc. of the operation-and-setting unit 80. Specifically, the buttons, etc. of the operation-and-setting unit 80 is used to input the start date and end date of the daylight saving time. The start date and end date of the daylight saving time are stored in the daylight saving time information storage unit 91. Further, as described above, by operating the buttons, etc. of the operation-and-setting unit 80, time differences allocated to the areas can be input. This time difference is stored to the regional information storage unit 70.

The reception management unit 62 of the radio-controlled adjustment section 60 waits for the arrival of the pre-set timing (step S51). If it is not the timing (step S51: NO), waits for the instruction to perform forcible reception (step S52) The instruction of the forcible reception is given by the operation-and-setting unit 80, when the user turns the switches of the operation-and-setting unit 80 on.

When it is the pre-set timing (step S51; YES), or when the instruction to perform the forcible reception is given (step S52: YES), the reception management unit 62 activates the reception circuit 61, the code extraction unit 63, the code determination unit 64, and the time information determination unit 67.

The activated reception circuit 61 receives a standard wave via the antenna AT (step S53).

The reception circuit 61, after amplifying the standard wave, detects a time signal.

The code extraction unit 63 detects a pulse duration of the time signal detected by the reception circuit 61, extracts codes corresponding to the binary codes and the position marker for the time information, and the codes corresponding to the daylight saving time information (step S54).

The code determination unit 64 detects the beginning of one frame from the codes extracted by the code extraction unit 63. After detecting the beginning of one frame, the code determination unit 64 starts converting the binary code into time information, such as hour and minute, based on the format specified in the standard wave (WWVB), and starts code determination to determine whether each item of the daylight saving time information and the time information is normal.

When completing reception of one frame, the time information determination unit 67 execute the determination on the time information and the daylight saving time information (step S55).

In the determination on the time information and the daylight saving time information, the time information determination unit 67 references to the time information and the daylight saving time information collected by the time information storage unit 65, and determines whether each value of the time information and the daylight saving time information is valid as information, in the same way as the first embodiment.

The time information determination unit 67 determines whether the determination on the time information and the daylight saving time information revealed that all the items of the time information and daylight saving time information have become together normal. When determining that all the items are together normal (step S56: YES), the time information determination unit 67 supplies the time information and the daylight saving time information to the date-and-time information generation unit 69, after advancing it by one minute.

On the other hand, when all the items of time information are not together normal (step S56: NO), the time information determination unit 67 stores only time information which has been determined to be normal to the temporary storage unit 66. When the time information or daylight saving time information is temporarily stored in the temporary storage unit 66, the time information interpolation unit 68 advances the time information stored in the temporary storage unit 66. After the advancement of the time information, time information interpolation unit 68 interpolates the time information or daylight saving time information read from the temporary storage unit 66, and stores it to the time information storage unit 65.

After the execution of the interpolation of the time information or daylight saving time information, the process goes back to step S54, and the determination of code extraction, code determination, collecting of time information, and determination of time information are executed. By the execution of code extraction, code determination, collecting of time information, and determination of time information, reception process of the time information of new frame is continued.

When all the items of the time information and the daylight saving time information are together normal (step S56: YES), and as a result of that, when the time information and the daylight saving time information are input from the time information determination unit 67, the date-and-time information generation unit 69 generates a time that corresponds to the given time information. The date-and-time information generation unit 69 adds the time difference stored in the regional information storage unit 70 to the time, and generates an area time (step S57).

The date-and-time information generation unit 69, further, determines whether the auto daylight saving time control section 90 is enabled or disabled. In this determination, it is determined that the auto daylight saving time control section 90 is enabled when the daylight saving time information storage unit 91 stores a daylight saving time period, and determines that the saving time control unit 90 is disabled when the daylight saving time information storage unit 91 does not store such daylight saving time period.

When it is determined that the auto daylight saving time control section 90 is enabled (step S58: YES), the date-and-time information generation unit 69 adjusts the time which the clocking unit 50 is clocking, by the area time generated in step S57 (step S60).

When it is determined that the auto daylight saving time control section 90 is disabled (step S58: NO), the date-and-time information generation unit 69 confirms whether the standard wave indicates that it is in the period of the daylight saving time. When the standard wave indicates that it is in the period of the daylight saving time, the date-and-time information generation unit 69 adds one hour to the area time to adjust the area time, and does not adjust the area time when the standard wave indicates it is not within the period of the daylight saving time (step S59). The area time adjusted or not adjusted in step S59 is used to adjust the time the clocking unit 50 is clocking (step S60).

After the adjustment of the time which the clocking unit 50 is clocking is completed, the date-and-time information generation unit 69 generates a determination request to the auto daylight saving time control section 90 (step S61).

Here, as shown in FIG. 8, the daylight saving time determination unit 92 is waiting for a determination request (step S72: NO) when the daylight saving time information storage unit 91 stores the start date and the end date of the daylight saving time in advance and the auto daylight saving time control section 90 is enabled (step S71: YES).

When it is determined that there is a determination request (step S72: YES), the daylight saving time determination unit 92 determines whether the determination request is from the radio-controlled adjustment section 60 or from the operation-and-setting unit 80. The request from the radio-controlled adjustment section 60 is one which is generated by the date-and-time information generation unit 69. A determination request generated by the operation-and-setting unit 80 is generated by the operation-and-setting-unit in the case where the user has input that time to the operation-and-setting unit 80 to change the time which the clocking unit 50 is clocking.

When the determination request is from the radio-controlled adjustment section 60 (step S73: radio-controlled adjustment section), the daylight saving time determination unit 92 references to the daylight saving time information storage unit 91, and determines whether the time of the clocking unit 50 is before, after, or on the start date of the daylight saving time pre-set to the daylight saving time information storage unit 91. When it is the date of the pre-set daylight saving time (step S74: that date), the daylight saving time determination unit 92 determines whether the time is before or after the time to enter the daylight saving time (adjustment time).

When determining that it is on or after the time to enter the daylight saving time (step S75: on or after) or, when determining that it is after the start date of the daylight saving time (step S74: after) the daylight saving time determination unit 92 determines whether the time of the clocking unit 50 is before, after or on the pre-set end date of the daylight saving time.

When determining that it is the end date of the daylight saving time (step S76: the date) the daylight saving time determination unit 92 determines whether the time of the clocking unit 50 is on or after, or before the time decremented by one hour from the end time of the daylight saving time (adjustment time). If it is determined that the time of the clocking unit 50 is before the time decremented by one hour from the end time of the daylight saving time (step S77: before) or before the end date of the daylight saving time (step S76: before), this case corresponds to the user-set daylight saving time period, and therefore, the daylight saving time determination unit 92 increments the time the clocking unit 50 is clocking by one hour (step S78). Then, the daylight saving time determination unit 92 turns the daylight saving time flag ON (step S79).

When in the determination in step S74, it is determined that the time which the clocking unit 50 is clocking is before the start date of the daylight saving time (step S74: before); when in the determination in step S75 it is determined that the time which the clocking unit 50 is clocking is before the time to enter the daylight saving time (step S75: before); when in the determination in step S76 it is determined that the time which the clocking unit 50 is clocking is after the end date of the daylight saving time (step S76: after); or when in the determination in step S77 it is determined that the time which the clocking unit 50 is clocking is on or after the one-hour decremented time decremented with respect to the end time of the daylight saving time (step S77: on or after), the daylight saving time determination unit 92 turns the daylight saving time flag off (step S80).

On the other hand, when in the process in step S73 it is determined that the determination request is from the operation-and-setting unit 80 (step S73: operation-and-control), the daylight saving time determination unit 92 references to the daylight saving time information storage unit 91, and determines whether the time which the clocking unit 50 is clocking is before, after or on the start date of the user-set daylight saving time If it is that date of the user-set daylight saving time (step S81: that date), the daylight saving time determination unit 92 determines whether it is before or after the time to enter the daylight saving time (adjustment time).

When it is determined that it is on or after the time to enter the daylight saving time (step S82: on or after) or, when it is determined that it is after the start date of the daylight saving time (step S81: after), the daylight saving time determination unit 92 determines whether the time which the clocking unit 50 is clocking is before, after or on the end date of the user-set daylight saving time.

When it is determined that it is the end date of the daylight saving time (step S83: the end date), the daylight saving time determination unit 92 determines, whether the time the clocking unit 50 is clocking is on or after the end time of the daylight saving time (adjustment time). When the time of the clocking unit 50 is before the end time of the daylight saving time (step S84: before) or end date of the daylight saving time (step S83: before), this case corresponds to the user-set daylight saving time period, and therefore, the daylight saving time determination unit 92 turns the daylight saving time flag on (step S85).

When in the determination in step S81 it is determined that the time which the clocking unit 50 is clocking is before the start date of the daylight saving time (step S81: before); when in the determination in step S82 it is determined that the time which the clocking unit 50 is clocking is before the time to enter the daylight saving time (step S82: before); when in the determination in step S83 it is determined that the time which the clocking unit 50 is clocking is after the end date of the daylight saving time (step S83: after; or, when in the determination in step S84 it is determined that the time of the clocking unit 50 is on or after the end time of the daylight saving time (step S84: on or after), the daylight saving time determination unit 92 turns the daylight saving time flag off (step S80).

By the process performed by the daylight saving time determination unit 92, it is possible to perform the adjustment in accordance with the user-set daylight saving time period when adjustment of the time of the clocking unit 50 based on the standard wave is performed, and when the adjustment of the time of the clocking unit 50 using the operation-and-setting unit 80 is performed.

On the other hand, as shown in FIG. 8, when the daylight saving time information storage unit 91 stores in advance the start date and the end date of the daylight saving time, and when the auto daylight saving time control section 90 is enabled (step S91: YES), the daylight saving time execution unit 93 monitors the time which the clocking unit 50 is clocking, while waiting for the refresh of minute (step S92: NO).

When it is determined that the clocking unit 50 has refreshed minute, (step S92: YES), the daylight saving time execution unit 93 determines whether the daylight saving time flag is on or off. When the daylight saving time flag is off (step S93: OFF) the daylight saving time execution unit 93 determines whether the time of the clocking unit 50 is on the start date of the user-set daylight saving time. When the time of the clocking unit 50 is on the start date of the daylight saving time (step S94: YES), the daylight saving time execution unit 93 determines whether the time of the clocking unit 50 is the time to enter the daylight saving time (adjustment time). When the time of the clocking unit 50 is the time to enter the daylight saving time (step S95: YES), the time of the clocking unit 50 is incremented by one hour (step S96). Then, the daylight saving time execution unit 93 turns the daylight saving time flag on (step S97). That is, when the time which the clocking unit 50 is clocking enters the user-set daylight saving time period, the time of the clocking unit 50 is incremented by one hour.

When in the determination in step S93 it is determined that the daylight saving time flag is ON (step S93: ON), the daylight saving time execution unit 93 determines whether the time of the clocking unit 50 is on the end date of the user-set daylight saving time. When the time of the clocking unit 50 is on the end date of the daylight saving time (step S98: YES), the daylight saving time execution unit 93 determines whether the time of the clocking unit 50 is the time to be out of the daylight saving time (adjustment time). When the time of the clocking unit 50 is the time to be out of the daylight saving time (step S99: YES), the time of the clocking unit 50 is decremented by one hour (step S100). Then, the daylight saving time execution unit 93 turns the daylight saving time flag on (step S101).

When the time which the clocking unit 50 is clocking enters the user-set daylight saving time period as a result of the process performed by the daylight saving time execution unit 93, the time of the clocking unit 50 is incremented by one hour, and when the time is off the daylight saving time period, the time of the clocking unit 50 is resumed to the original.

In the radio-controlled adjustment timepiece having the above-described structure of this embodiment is capable of causing the clocking unit 50 to perform clocking in accordance with a user-set daylight saving time period whether the time information contained in the standard wave is of the daylight saving time or of the winter time.

In the case where the start date and end date of the daylight saving time of the user-input daylight saving time is the same date, the user-designated daylight saving time period becomes substantially null, and the daylight saving time based on the standard wave is applied.

Further, when the user does not input the start date and end date of the daylight saving time, the auto daylight saving time control section 90 is disabled; therefore, the clocking unit 50 clocks the time in accordance with the time information given by the standard wave.

The present invention is not limited to the above embodiment, and various modifications thereof can be made.

For example, in the case where there is different time zones varying dependent on the area as described in the second embodiment, the radio-controlled adjustment section 60 may be caused to receive the standard wave, and adjust the time of the clocking unit 50 in accordance with the result of the reception, when the time which the clocking unit 50 is clocking and which is adjusted by the time difference becomes the time to enter the daylight saving time of the start date of the daylight saving time or after that time. If so configured, the necessity to determine whether the current time at the area is before or after the daylight saving time transition time, after 0 o' clock of Zulu time is eliminated; the process on the transition date to the daylight saving time or winter time is simplified; and the software efficiency is improved.

INDUSTRIAL APPLICABILITY

According to the present invention, a radio-controlled adjustment timepiece can be provided, wherein it is possible to select whether adjusting for or not adjusting for a daylight saving time, and uniquely set a period of the daylight saving time.

The invention claimed is:

1. A radio-controlled adjustment timepiece comprising:

a receiver which receives a standard wave containing time information and received daylight saving information indicating whether or not the time information is provided by being adjusted by a time adjustment value for a period of daylight saving time, a clock which keeps a clock time;

a storer which stores a period of daylight saving time set in advance independently from the received daylight saving information contained in regards to the period of daylight saving time in the standard wave;

a first adjuster which adjusts the clock time to match the time information received by the receiver;

a controller which, when information which indicates that the first adjuster performed the adjustment and the received daylight saving information upon the adjustment by the first adjuster are notified, references to the contents stored in the storer and a stored daylight saving information, determines whether a present point is in a set daylight saving time period, specifies a current time, and adjusts the clock time after the adjustment by the first adjuster, by the specified current time; and a notifier which notifies the information which indicates that the first adjuster performed the adjustment and the stored daylight saving information upon the adjustment by the first adjuster to the controller, wherein the controller detects whether the clock time after the adjustment by the first adjuster includes the time adjustment value from the stored daylight saving information notified by the notifier, when detecting that the clock time after the adjustment by the first adjuster includes the time adjustment value, subtracts the time adjustment value from the clock time, determines whether the clock time derived by subtracting the time adjustment value is in the set daylight saving time period, when determining that the clock time derived by subtracting the time adjustment value is in the set daylight saving time period, specifies the clock time derived by subtracting the time adjustment value plus the time adjustment value as the current time, and when determining that the clock time derived by subtracting the time adjustment value is not in the set daylight saving time period, specifies the clock time derived by subtracting the time adjustment value as the current time, and when detecting that the clock time after the adjustment by the first adjuster does not include the time adjustment value, determines whether the clock time is in the set daylight saving time period, when determining that the clock time is in the set daylight saving time period, specifies the clock time plus the time adjustment value as the current time, and when determining that the clock time is not in the set daylight saving time period, specifies the clock time as the current time, and adjusts by the specified current time the clock time after the adjustment by the first adjuster.

2. The radio-controlled adjustment timepiece according to claim 1, further comprising a second adjuster which: disables the controller; when the time information contains the time adjustment value, specifies a time derived by subtracting the time adjustment value from the time information as the current time, and when the time information does not contain the time adjustment value, specifies a time indicated by the time information as the current time; and adjusts the clock time by the specified current time.

3. The radio-controlled adjustment timepiece according to claim 2, further comprising a third adjuster which disables the controller, and adjusts the clock time, by setting a time indicated by the time information as the current time.

4. The radio-controlled adjustment timepiece according to claim 1, further comprising a third adjuster which disables the controller, and adjusts the clock time, by setting a time indicated by the time information as the current time.

5. A radio-controlled adjustment timepiece comprising:

a receiver which receives a standard wave including time information and daylight saving information indicating whether or not a current time point indicated by the time information is in a daylight saving time;

a clock which keeps a clock time;

a storer which stores a period of daylight saving time set independently from the daylight saving information contained in regards to the period of daylight saving time in the standard wave;

a controller which: references to contents stored in the storer; determines whether the clock time is in a set daylight saving time period; when determining that the clock time is in the set daylight saving time period, specifies the time information plus a time adjustment value for the daylight saving time period as the current time, and specifies the time information as the current time when determining that the clock time is not in the set daylight saving time period; and adjusts the clock time by the specified current time;

a first adjuster which adjusts the clock time to match the time information received by the receiver; and a notifier which notifies information which indicates that the first adjuster performed the adjustment to the controller, wherein the controller, when the first adjuster adjusts the clock time by the time information, in cases where the clock time after the adjustment by the first adjuster is from a start timing of the set daylight saving time period until a timing, which an end timing of the set daylight saving time period goes back to by a time corresponding to the time adjustment value, determines that a present time is in the set daylight saving time period, sets the clock time and which is adjusted by the time information plus the time adjustment value for the daylight saving time period as the current time, and turns on a flag indicating being in the set daylight saving time period, and in case of determining that the time after the adjustment by the first adjuster is not in the set daylight saving time period, turns the flag off, confirms a state of the flag for determining whether the clock time is in the set daylight saving time period, and in cases where the flag is off, determines whether the clock time is the start timing of the set daylight saving time period, when the clock time reaches the start timing, adds the time adjustment value to the clock time and turns the flag on, and in cases where the flag is on, determines whether the clock time is the end timing of the set daylight saving time period, when the clock time reaches the end timing, subtracts the time adjustment value from the clock time and turns the flag off.

6. The radio-controlled adjustment timepiece according to claim 5, further comprising a second adjuster which: disables the controller; when the daylight saving information indicates being within the daylight saving time period, specifies the time information plus the time adjustment value as the current time; and when not being within the daylight saving time period, specifies a time which the time information indicates as the current time; and adjusts the clock time, by the specified current time.

7. The radio-controlled adjustment timepiece according to claim 6, further comprising a third adjuster which disables the controller, specifies the time indicated by the time information as the current time, and adjusts the clock time, by the specified current time.

8. The radio-controlled adjustment timepiece according to claim 5, further comprising a third adjuster which disables the controller, specifies a time indicated by the time information as the current time, and adjusts the clock time by the specified current time.

9. The radio-controlled adjustment timepiece according to claim 5, further comprising a time difference adjuster which adjusts the clock time, by adding a value which corresponds to a time difference set separately for each time zone.

10. The radio-controlled adjustment timepiece according to claim 9, wherein the receiver receives the standard wave on or after that the time adjusted by the time difference adjuster becomes the set daylight saving time period, and the controller adjusts the clock time, based on a result of reception of the standard wave by the receiver.

* * * * *